US010206847B1

(12) United States Patent
Tekulve

(10) Patent No.: US 10,206,847 B1
(45) Date of Patent: Feb. 19, 2019

(54) PORTABLE REHAB STATION

(71) Applicant: Daniel R. Tekulve, Batesville, IN (US)

(72) Inventor: Daniel R. Tekulve, Batesville, IN (US)

(73) Assignee: Med-Mizer, Inc., Batesville, IN (US)

( * ) Notice: Subject to any disclaimer, the term of this patent is extended or adjusted under 35 U.S.C. 154(b) by 0 days.

(21) Appl. No.: 15/218,791

(22) Filed: Jul. 25, 2016

Related U.S. Application Data

(63) Continuation of application No. 14/508,558, filed on Oct. 7, 2014, now Pat. No. 9,398,995.
(Continued)

(51) Int. Cl.
*A61H 3/00* (2006.01)
*A63B 22/00* (2006.01)

(52) U.S. Cl.
CPC ..... *A61H 3/00* (2013.01); *A61H 3/008* (2013.01); *A63B 22/00* (2013.01); *A63B 2022/0094* (2013.01)

(58) Field of Classification Search
CPC . A63B 1/4035; A63B 21/068; A63B 21/0428; A63B 21/00047; A63B 2210/50; A63B 21/4029; A63B 2225/09; A63B 2225/093; A63B 23/0211; A63B 22/20; A63B 2208/0233; A63B 22/16; A63B 22/18; A63B 21/4047; A63B 26/00; A63B 23/00; A61G 7/1046; A61G 7/1051;
(Continued)

(56) References Cited

U.S. PATENT DOCUMENTS 2,139,166 A * 12/1938 Leuchter ..... A61H 1/02 482/903
2,739,783 A * 3/1956 Pentecost ..... A61G 7/1017 212/203
(Continued)

FOREIGN PATENT DOCUMENTS

GB 1469593 4/1977
GB 2277302 A 10/1994
(Continued)

OTHER PUBLICATIONS

International Search Report and Written Opinion dated Jan. 16, 2015, Application No. PCT/US2014/059464, 7 pages.

*Primary Examiner* — Andrew S Lo
(74) *Attorney, Agent, or Firm* — R. Randall Frisk

(57) ABSTRACT

A portable rehab station, including left and right outriggers, each having a forward end and a rearward end, the left and right outriggers being pivotally connected at the bottom ends of the respective left and right frame members to pivot between retracted and expanded positions, the retracted position including the left and right outriggers being generally mutually parallel, and the expanded position including the left and right outriggers being spread out at an angle of between about six and ten degrees relative to each other;

a front, ground-engageable caster connected to the forward end of each of the left and right outriggers and a rear, ground-engageable caster connected to the rearward end of each of the left and right outriggers; and an actuator assembly connected with the frame and operably connected with the left and right outriggers to selectively pivot the left and right outriggers between the retracted and expanded positions.

6 Claims, 9 Drawing Sheets

Related U.S. Application Data

(60) Provisional application No. 61/887,974, filed on Oct. 7, 2013.

(58) Field of Classification Search
CPC ..... A61G 2200/34; A61G 7/1019; A61G 7/1017; A61G 7/1055; A61G 2200/36; A61G 7/1042; A61G 7/1076; A61G 7/1057; A61G 5/14; A61G 7/1067; A61G 7/10; A61G 2200/16; A61G 7/1038; A61G 5/04; A61G 7/0533; A61G 7/1036; A61G 7/1053; A61G 7/1063; A61G 2005/1089; A61G 2007/051; A61H 3/04; A61H 3/008
USPC ..... 482/131, 133–139, 142, 143, 148; 601/23–35; 5/83.1, 86.1, 87.1, 89.1
See application file for complete search history.

(56) References Cited

U.S. PATENT DOCUMENTS 2,818,315 A * 12/1957 Limbach ..... A61G 7/10 5/600
2,903,238 A * 9/1959 Flandrick ..... A61G 7/1017 212/238
2,928,675 A * 3/1960 Nawara ..... A63B 21/154 482/133
3,373,993 A * 3/1968 Oja ..... A63B 21/00181 280/43.14
3,596,298 A * 8/1971 Durst, Jr. ..... A61G 7/1017 297/411.1
3,877,421 A * 4/1975 Brown ..... A61G 7/1017 482/57
4,175,550 A * 11/1979 Leininger ..... 5/109
4,355,633 A * 10/1982 Heilbrun ..... A61H 1/0214 482/903
4,531,727 A * 7/1985 Pitre ..... A63B 21/06 482/101
4,638,516 A * 1/1987 Vrzalik ..... A61G 7/002 5/611
4,703,523 A * 11/1987 James ..... A61G 7/1017 5/83.1
4,704,749 A * 11/1987 Aubert ..... A61G 7/1019 280/250.1
5,005,829 A * 4/1991 Caruso ..... A63B 21/4047 482/112
5,022,106 A * 6/1991 Richards ..... A61G 7/1017 4/254
5,261,640 A * 11/1993 Yuan ..... B66C 23/48 254/8 B
5,311,880 A * 5/1994 Lancaster ..... A61B 5/1036 135/67
5,390,380 A * 2/1995 James-Wallace ..... A61G 7/053 212/260
5,411,044 A * 5/1995 Andolfi ..... A61G 7/1019 135/66
5,502,851 A * 4/1996 Costello ..... A61H 3/04 482/69
5,603,677 A * 2/1997 Sollo ..... A61H 1/0229 135/67
5,632,726 A * 5/1997 Repice ..... A61F 5/04 601/33
5,800,318 A * 9/1998 Coviello ..... A61H 3/04 135/67
5,892,180 A * 4/1999 Carey ..... A61G 7/1017 177/144
5,971,512 A 10/1999 Swan
6,047,418 A * 4/2000 Seide ..... A61G 7/1015 5/81.1 R
6,079,062 A * 6/2000 Mullin ..... A61G 7/1019 5/81.1 R
6,092,247 A * 7/2000 Wilson ..... A61G 7/1011 5/81.1 R
6,135,131 A * 10/2000 Downing ..... A61G 7/10 135/67
6,142,914 A * 11/2000 Crawford ..... A61H 1/0214 280/304.1
6,175,973 B1 * 1/2001 Hakamiun ..... A61G 7/1017 5/86.1
6,276,665 B1 * 8/2001 Hawkins ..... B66C 23/48 254/124
6,302,828 B1 * 10/2001 Martin ..... A61H 3/008 482/43
6,321,398 B1 * 11/2001 Wang ..... A61G 7/001 212/901
6,430,761 B1 * 8/2002 Brandorff ..... A61G 7/053 5/81.1 R
6,581,222 B1 * 6/2003 Liljedahl ..... A61G 7/1017 5/83.1
6,685,605 B1 * 2/2004 Klossner ..... A61H 1/02 482/142
6,862,762 B1 * 3/2005 Johnson ..... A61B 6/0442 378/177
7,020,913 B2 * 4/2006 Van Scheppingen ..... A61G 7/1017 24/648
7,036,512 B2 * 5/2006 Harnois ..... A61G 5/14 128/845
7,162,757 B2 * 1/2007 Edgerton ..... A61G 7/05 5/509.1
7,294,094 B1 * 11/2007 Howle ..... A61H 3/00 135/67
7,506,388 B1 * 3/2009 Brown ..... A61G 7/1017 5/86.1
8,250,687 B2 * 8/2012 Spidare ..... A61G 7/1017 5/81.1 R
8,272,084 B2 * 9/2012 Spidare ..... A61G 7/1017 5/81.1 R
8,348,869 B2 * 1/2013 Su ..... A61H 1/0281 601/23
8,479,327 B2 * 7/2013 McKenney ..... A61G 7/1038 5/81.1 R
8,650,677 B2 * 2/2014 Altena ..... 5/81.1 R
8,663,136 B1 * 3/2014 Alsaffar ..... A61H 3/008 135/67
2001/0048206 A1 * 12/2001 Niu ..... A61H 3/04 280/87.021
2002/0038477 A1 * 4/2002 Mowery ..... A61G 7/1015 5/86.1
2003/0000013 A1 * 1/2003 Schroeter ..... A61G 7/1017 5/86.1
2003/0004444 A1 * 1/2003 Perner ..... A61F 5/0102 601/29
2004/0002407 A1 * 1/2004 Hawkes ..... A61H 3/008 482/69
2004/0087880 A1 * 5/2004 Mason ..... A61H 1/0277 601/5
2004/0177441 A1 * 9/2004 Ronne ..... A61G 7/1017 5/86.1
2005/0039256 A1 * 2/2005 Price ..... A61G 7/1011 5/86.1
2005/0097670 A1 * 5/2005 Hawk ..... A61G 7/05 5/84.1
2005/0217024 A1 * 10/2005 Aarestad ..... A61G 7/1015 5/86.1
2005/0236824 A1 10/2005 Wissler
2005/0283906 A1 * 12/2005 Summers ..... A61G 7/1015 5/86.1
2005/0288157 A1 * 12/2005 Santos-Munne ..... A61H 3/008 482/66
2006/0009332 A1 * 1/2006 Jones ..... A61H 1/0255 482/54
2006/0137091 A1 * 6/2006 Gramkow ..... A61G 7/1015 5/86.1
2006/0160676 A1 * 7/2006 Sato ..... A63B 21/00181 482/94
2006/0162069 A1 * 7/2006 Mowery ..... A61G 7/1015 5/86.1

(56) References Cited

U.S. PATENT DOCUMENTS

2006/0248649 A1* 11/2006 Kuenzel ..... A61G 5/006 5/618
2006/0276311 A1* 12/2006 Martin ..... A63B 21/00181 482/92
2006/0293156 A1* 12/2006 Trees ..... A61H 1/0229 482/148
2007/0000049 A1* 1/2007 White ..... A61G 7/1015 5/84.1
2007/0067905 A1* 3/2007 Wilder ..... A61G 7/1011 5/83.1
2007/0208283 A1* 9/2007 Neff ..... A61H 1/005 601/49
2007/0281842 A1* 12/2007 Thornton ..... A61H 3/008 482/143
2008/0014069 A1* 1/2008 Vandyke ..... A61G 5/104 414/546
2008/0216232 A1* 9/2008 White ..... A61G 7/1015 5/87.1
2009/0069161 A1* 3/2009 Caldwell ..... A63B 21/00047 482/138
2009/0098987 A1 4/2009 McBride
2009/0119835 A1* 5/2009 Liljedahl ..... A61G 5/00 5/87.1
2009/0144895 A1* 6/2009 Bostelman ..... A61G 7/1007 5/87.1
2009/0249544 A1* 10/2009 Palay ..... A61G 5/14 5/83.1
2009/0298653 A1* 12/2009 Rodetsky ..... A61H 1/0262 482/69
2010/0132117 A1* 6/2010 Westermann ..... A47C 20/041 5/600
2010/0154115 A1* 6/2010 Wernqvist ..... A61G 7/1017 5/86.1
2010/0222716 A1* 9/2010 Olsen ..... A61H 3/008 601/26
2010/0318005 A1* 12/2010 Amonette ..... A61H 3/008 601/23
2011/0056019 A1* 3/2011 Altena ..... A61G 5/14 5/87.1
2011/0166487 A1* 7/2011 Fullenkamp ..... A61H 1/0237 601/33
2011/0289681 A1* 12/2011 Biersteker ..... A61G 7/1046 5/86.1
2011/0302711 A1* 12/2011 Biersteker ..... A61G 7/1046 5/87.1
2011/0302712 A1* 12/2011 Patterson ..... A61G 7/1019 5/88.1
2012/0046578 A1* 2/2012 Agrawal ..... A61H 1/024 601/35
2013/0178767 A1* 7/2013 Dreske ..... A61H 3/008 601/23
2013/0197407 A1* 8/2013 Flythe, Jr. ..... A61H 1/0262 601/34
2013/0318708 A1* 12/2013 Wang ..... A61G 7/1003 5/87.1
2014/0068855 A1* 3/2014 Grow ..... A61G 7/1017 5/87.1
2014/0289958 A1* 10/2014 Hjort ..... A61G 7/1007 5/83.1
2014/0289959 A1* 10/2014 Hjort ..... A61G 5/14 5/83.1
2015/0052680 A1* 2/2015 Brandorff ..... A61G 7/1051 5/89.1
2015/0231005 A1* 8/2015 Gray ..... A61G 5/14 5/86.1
2015/0246264 A1* 9/2015 Lampert ..... A63B 23/035 482/4

FOREIGN PATENT DOCUMENTS

NL 1011530 C1 9/2000
WO 2006/017691 A2 2/2006

* cited by examiner

PORTABLE REHAB STATION

REFERENCE TO RELATED APPLICATION

This application is a continuation of U.S. patent application Ser. No. 14/508,558, filed Oct. 7, 2014, which claims the benefit of Provisional Patent Application No. 61/887,974, filed Oct. 7, 2013, which applications are hereby incorporated by reference in their entireties.

FIELD OF THE INVENTION

The present invention relates to the field of health care devices, and more specifically, to a portable multifunction rehab station.

BACKGROUND OF THE INVENTION

Physical therapy or physical rehabilitation is the treatment of physical injury or impairment through therapeutic exercise and the application of modalities that are intended to restore, facilitate and improve normal function or development. Such treatment, typically under the supervision and care of a licensed physical therapist, can be categorized into five different therapy regimes: resistance/strength training; balance and agility training; functional training; endurance/aerobic training; and flexibility training. Treatment under each of these regimes will typically include the use of several different pieces of equipment. For example, resistance/strength training usually incorporates application of resistance in opposition to the force of muscular contraction, the resistance being provided by tension via elastic, hydraulic or suspended mass (weights) components. Endurance/aerobic training includes light-to-moderate exercising for extended periods of time, such as rowing, walking or jogging which, when performed indoors, would require a rowing machine, treadmill or the like. The equipment for these therapies are often conveniently combined into one location, such as a spa or physical therapy center, but some patients may be unable, or perhaps reluctant, to travel even a short distance to the physical therapy equipment.

What is needed is a rehabilitation station that can be easily moved from one patient to another and provide a plurality of physical therapy exercises/modalities.

SUMMARY

A portable rehab station includes left and right outriggers, each having a forward end and a rearward end, the left and right outriggers being pivotally connected at the bottom ends of the respective left and right frame members to pivot between retracted and expanded positions, the retracted position including the left and right outriggers being generally mutually parallel, and the expanded position including the left and right outriggers being spread out at an angle of between about six and ten degrees relative to each other. The portable rehab station further includes a front, ground-engageable caster connected to the forward end of each of the left and right outriggers and a rear, ground-engageable caster connected to the rearward end of each of the left and right outriggers; and includes an actuator assembly connected with the frame and operably connected with the left and right outriggers to selectively pivot the left and right outriggers between the retracted and expanded positions.

In addition, the portable rehab station includes left and right stabilizers, each having front and rear ends and at least one (and preferably one at each corner) ground-engageable grip pad, the left and right stabilizers are pivotably connected to respective left and right outriggers to pivot between an up, unlocked position and a down, locked position. The up, unlocked position includes the grip pads not being in engagement with ground and the portable rehab station being freely able to roll along ground via its casters, and the down, locked position includes the grip pads being in engagement with ground and the casters not being in engagement with ground.

The actuator assembly is operably connected with the left and right outriggers and the left and right stabilizers to simultaneously pivot the left and right outriggers between the retracted and expanded positions and pivot the left and right stabilizers between the up, unlocked position and down, locked position.

It is an object of the present invention to provide an improved rehabilitation station.

Further objects and advantages will become apparent from the following description of the preferred embodiment.

DESCRIPTION OF THE PREFERRED EMBODIMENT

Figure 1:
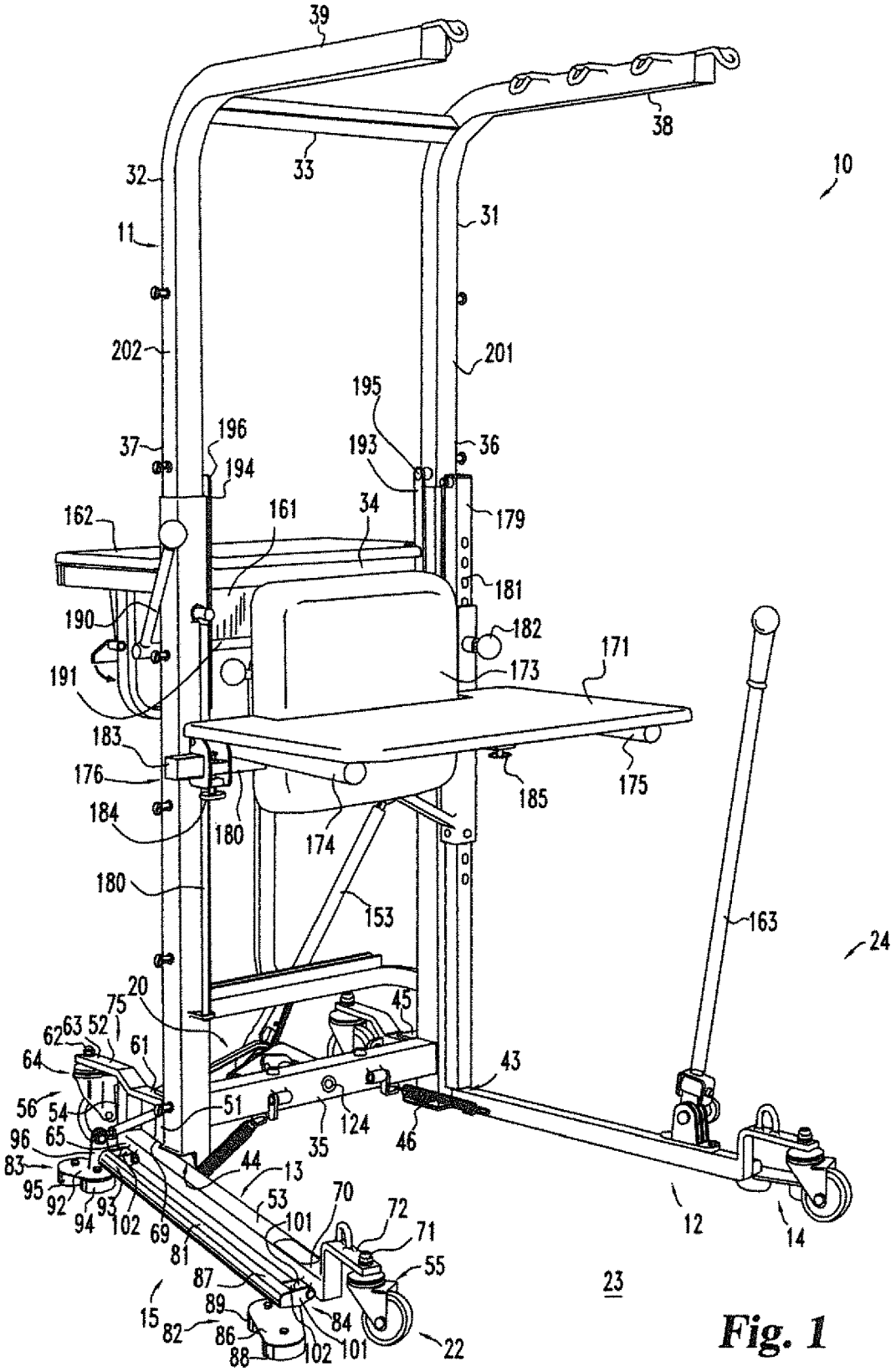
FIG. 1 is a perspective view of the portable rehab station 10 in accordance with one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Figure 3:
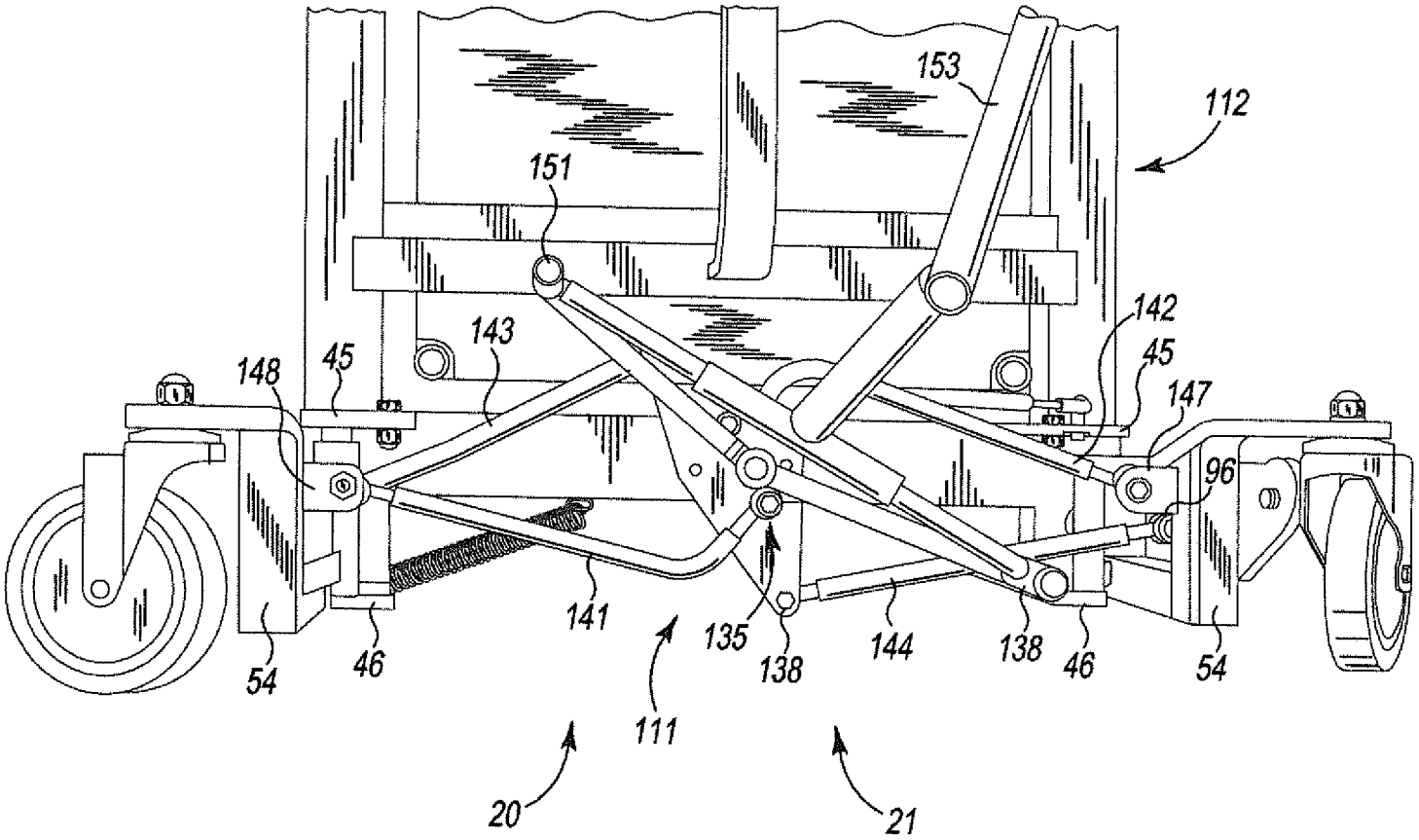
FIG. 3 is rear, elevational view of the portable rehab station 10 of FIG. 1 and shown with the actuator mechanism 20 in the up, unlocked position 21.
Figure 4:
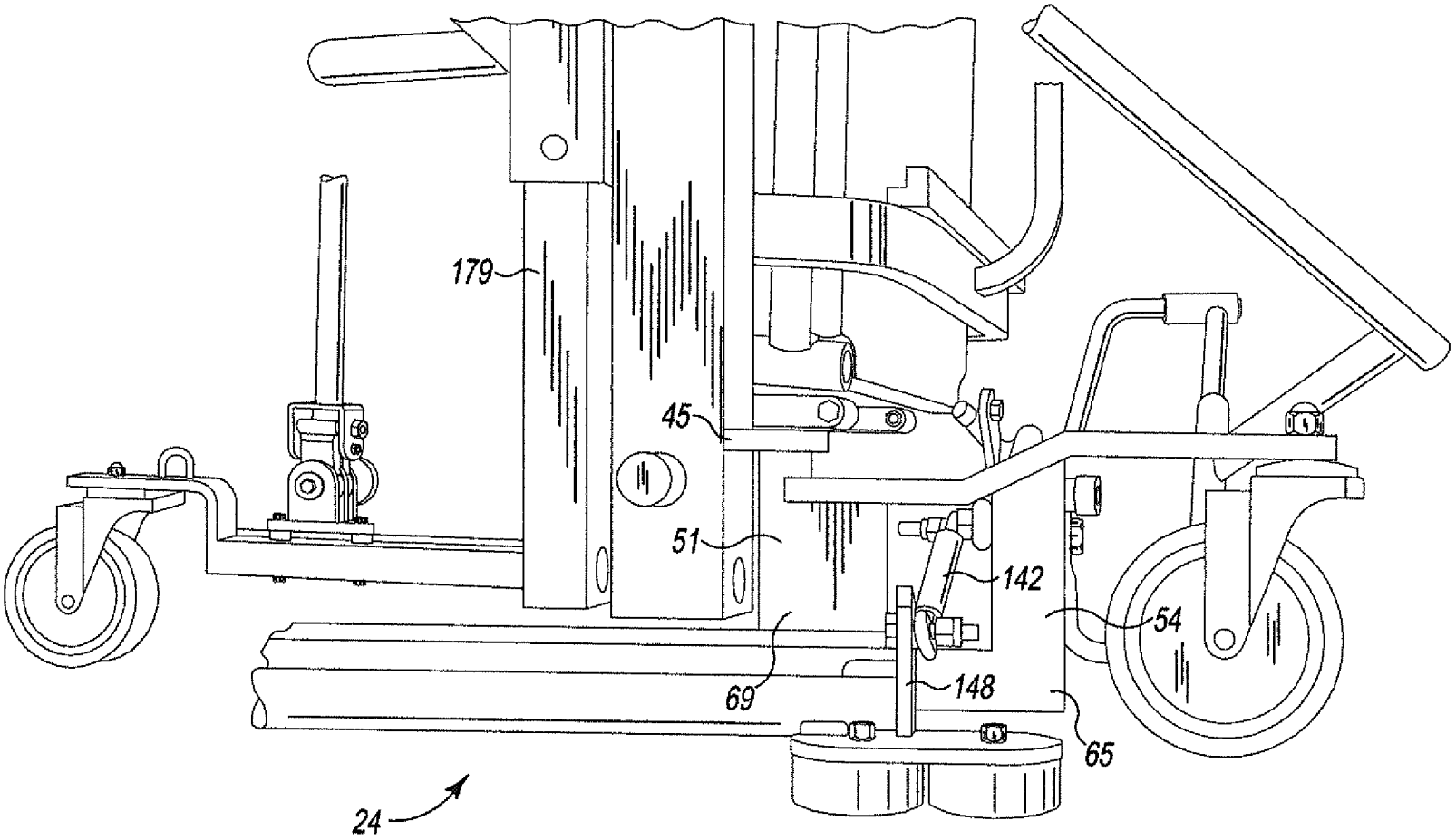
FIG. 4 is a side, elevational view of the rear of the portable rehab station 10 of FIG. 1 and shown with the actuator mechanism 20 in the down, unlocked position 24.
Figure 9:
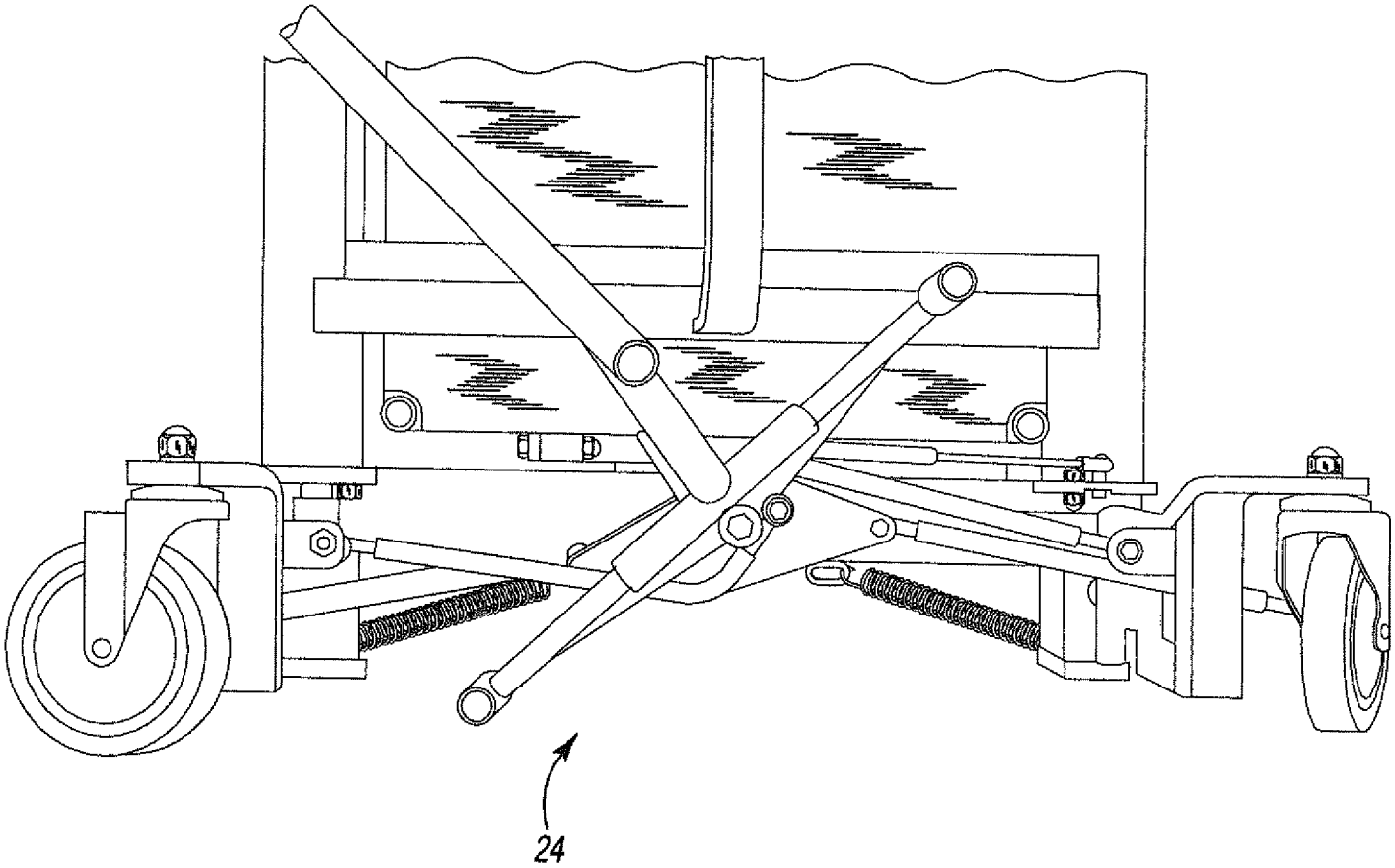
FIG. 9 is a rear, elevational view of the portable rehab station 10 of FIG. 3 and shown with the actuator mechanism 20 in the down, unlocked position 24.

Referring to FIG. 1 there is shown a portable rehab station 10 in accordance with one embodiment of the present invention. Portable rehab station 10 generally includes a frame 11, right and left outriggers 12 and 13, right and left stabilizers 14 and 15, and actuator mechanism 20 that is operable, in one embodiment, to move stabilizers 14 and 15 between an up, unlocked position 21 (where portable rehab station 10 can freely roll via is casters 22 on the floor 23, as shown in FIG. 3) and a down, locked position 24 where casters 22 are out of engagement with the floor 23 and portable rehab station 10 is relatively immovable upon floor 23, as shown in FIGS. 1 and 9. Relatively immovable here means that the portable rehab station 10 cannot freely move along the floor 23 without the application of substantial force. That is, in the up position 21, portable rehab station 10 can easily be rolled on its casters. In the down position 24, the weight of portable rehab station 10 upon its pads 88 and 89 and 94 and 95 creates a substantial friction force that resists any lateral movement on most surfaces.

Frame 11 includes right and left upstanding frame members 31 and 32 and top, middle and bottom cross members 33-35, respectively, rigidly extending therebetween. Frame members 31 and 32 each include vertical beams 36 and 37 that, at their upper ends, angle approximately 90 degrees therefrom into upper, generally horizontal equipment support arms 38 and 39. In one embodiment, vertical beams 36 and 37 are fixed in length. In the embodiment of FIG. 1 and as described herein, vertical beams 36 and 37 are configured to extend between a tall, working height and a short, transport height that can fit through standard doorways.

Figure 2:
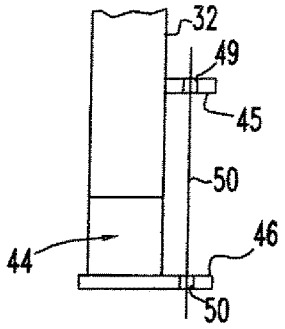
FIG. 2 is a side view of the bottom of vertical beam 37 of the portable rehab station 10 of FIG. 1 and showing the clearance notch 44 and pivot brackets 45 and 46.
Figure 10:
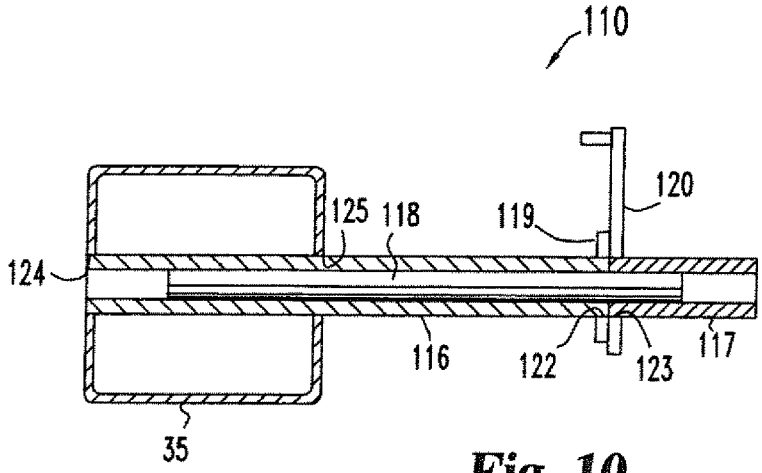
FIG. 10 is side, cross-sectional view of the center control assembly 110 of the actuator assembly 20 of the portable rehab station 10 of FIG. 1.

At their bottom ends, vertical beams 36/37 are notched on their outsides to define clearance (at 43 and 44) (FIGS. 1 and 2) for outriggers 12 and 13, as described herein. At their bottom ends, vertical beams 36 and 37 also each include upper and lower pivot brackets 45 and 46 (FIG. 1 and A) that extend rearwardly therefrom and define aligned holes 48 and 49.

Outriggers 12 and 13 are substantially mirror images of each other, and any differences therebetween will be pointed out, as appropriate. Referring to FIGS. 1 and 4-6, outriggers 12 and 13 each include a vertically extending pivot sleeve 51, a rear caster arm 52, a long arm 53, a connector beam 54 and caster assembly 22, which includes front and rear casters 55 and 56. One pivot sleeve 51 is journaled for rotation in between each pair of upper and lower pivot brackets 45 and 46 by a suitable pivot pin or axle (not shown) that is held in aligned holes 48 and 49 of pivot brackets 45 and 46. The pivot sleeves 51 are thus able to otherwise freely rotate about a vertical axis therein. Rear caster arm 52 is fixedly connected at its forward end 61 to the rear side of pivot sleeve 51, and rear caster 56 is connected via bolt 62 to extend downwardly from the rearward end 63 of rear caster arm 52, as shown. Rear caster 56 includes a wheel 67 that is journaled to pivot about a horizontal axis, which permits rolling movement of portable rehab station 10 in any lateral direction. Rear caster 56 is a locking caster with a foot operated locking mechanism 64 that can be readily locked and unlocked against rolling by a user's foot.

Connector beam 54 is rigidly connected to and extends downwardly from rear caster arm 52, roughly midway between its forward and rearward ends 61 and 63, respectively. At its rearward end 65, long arm 53 is rigidly connected to and extends forwardly from the bottom end of connector beam 54 to a rigid connection at 69 at the outer side of pivot sleeve 51 and therefrom forwardly to its forward end 70. Front caster 55 is connected via bolt 71 to extend downwardly from a front caster arm 72, which is fixedly connected to the forward end 70 of long arm 54, as shown. The rigid connection from and among pivot sleeve 51, rear caster arm 52, connector beam 54, long arm 53 and back to pivot sleeve 51 forms a rigid quadblock 75 from which rearwardly extends rear caster arm 52 to rear caster 56 and from which forwardly extends long arm 53 to front caster 55.

Alternative embodiments are contemplated wherein the combination of pivot sleeve 51, rear caster arm 52, connector beam 54 and long arm 53 and rear and front caster arms 52 and 72 comprises other elements, including for example, a single, shaped structure that is held for pivotal connection by pivot brackets 45 and 46 and that holds front and rear casters 55 and 56 in the same positions relative to their pivotal mountings at 45 and 46.

In one embodiment, the distance from the pivot axis 50 of pivot sleeve 51 (in holes 48 and 49) to the bolt 62 of rear caster 56 is about 11 inches, and the distance from the axis 50 of pivot sleeve 51 to the bolt 71 of front caster 55 is about 38 inches. The spacing of casters 55 and 56 relative to each other and, of course, relative to their counterparts on the opposite, left outrigger 12, and their combined connection to frame 11 is selected so that outriggers 12 and 13 provide reliable stability to portable rehab station 10 while it is being transported (rolled along the floor on its casters) and during all anticipated exercise activities performed thereon, as described and suggested herein.

Stabilizers 14 and 15 are substantially mirror images of each other, and any differences therebetween will be pointed out, as appropriate. Stabilizer 15 includes a long bar 81, front and rear feet 82 and 83 and stabilizer mounting elements 84. Front foot 82 includes a footplate 86 fixed to the underside of the forward end 87 of long bar 81 and a pair of ground engaging grip pads 88 and 89 that are connected to the underside of footplate 86. Pads 88 and 89 are made of rubber or any similar material that is strong enough and durable enough to support and withstand the weight of the portable rehab station 10 and the forces to which it will be subjected, and to grip and resist lateral movement of portable rehab station 10 on the floor 23 when stabilizer 15 is engaged to the down, locked position 24. Pads 88 and 89 are generally disc shaped and removably connected to footplate 86 by any appropriate means such as bolts and nuts. Rear foot 83 is similar to front foot 82 and has a footplate 92 that is fixed to the underside of the rearward end 93 of long bar 81 and has ground engaging pads 94 and 95 that are connected to the underside of footplate 92. A link bracket 96 rigidly connected to long bar 81 and footplate 92 and extends upwardly from footplate 92 for pivotal connection with a stabilizer link, as discussed herein.

The stabilizer mounting elements 84 include mounting ears 101 and 102 and companion stabilizer mounting sleeves 103. Stabilizers 14 and 15 are pivotally mounted to the outside sides of the long arms 53 of their companion outriggers 12 and 13, respectively. At each of the opposing ends 87/93 of the stabilizer long bar 81 there are a pair of mounting ears 101 and 102 that receive and are pivotally connected to a mating stabilizer mounting sleeve 103. Stabilizer 14 is thus connected to its outrigger 12 to pivot about an axis 106 that is parallel to long arm 53 of outrigger 12, and stabilizer 15 is likewise connected to its outrigger 13.

The sizes and configurations of the stabilizers, outriggers and their mating stabilizers (and their grip pads 88 and 89 and 94 and 95) are such that, when the stabilizers 14 and 15 are pivoted to their down, locked position 24, the outriggers, and thus the entire body of portable rehab station 10 connected to stabilizers 14 and 15, and most importantly, the casters 55 and 56, is lifted off of the floor and the entire weight of portable rehab station 10 is supported upon the grip pads 88 and 89 and 94 and 95.

Referring to FIGS. 1, 3 and 8-12, actuator mechanism 20 generally includes a center control assembly 110, an actuator linkage assembly 111 and an actuator input assembly 112.

Center control assembly 110 includes a main support rod 116, a control rod 117, a central support rod 118, an index plate 119 and a control plate 120. Main support rod 116 and control rod 117 are hollow tubes and have the same diameter sized to receive the central support rod 118 therein. The index plate 119 and control plate 120 have the shapes shown in FIGS. 10-12, which for both includes an identically sized, round central hole 122 (for index plate 119) and 123 (for control plate 120). The size of holes 122/123 matches with close tolerance the outer diameter of main support rod 116 and control rod 117. In assembly, one end of main support rod 116 is fixedly received and secured (as by welding) in holes 124/125 of the lower cross member 35. At the opposite, rearward end of rod 116, index plate 119 is secured thereto as by welding, the rear face of index plate 119 and the rear end of central support rod 118 there being substantially coplanar. Index plate 119 is thus suspended in a fixed and non-rotating position, in one embodiment, about six inches rearwardly of lower cross member 35. Control plate 120 is similarly affixed (such as by welding) to the forward end of control rod 117. Central support rod 118 is received within control rod 117 and held thereat by appropriate means such as a split ring or set screw. Central support rod 118 is sized to extend rearwardly of main support rod 116 so that central support rod 118 can be telescopically received into such control rod 117 whereby the forward face of control plate 120 and the rearward face of index plate 119 come together in parallel planar abutment and such that the control rod 117 and control plate 120 combination can turn as a unit about central support rod 118.

Index plate 119 defines open notches 131 and 132 that generally align with two outrigger holes 134 and 135 defined in control plate 120 when control plate 120 is rotated to a certain position. At its outer, generally opposing ends, control plate 120 defines stabilizer holes 137 and 138.

Actuator linkage assembly 111 includes four linkages—right and left outrigger links 141 and 142 and right and left stabilizer links 143 and 144, respectively. Right outrigger link 142 is pivotally connected at one end to control plate 120 at the upper and farthest stabilizer hole (134) (by appropriate means, which for a pivotal connection includes a bolt and nut, for example). (Such connections are well understood by those skilled in the art and are not further discussed). At its opposite, outboard end, right outrigger link 142 is pivotally connected to the rear portion of right outrigger 13. Such connection is here at a compatibly configured bracket 147 extending inwardly from connector beam 54. Left outrigger link 141 is similarly pivotally connected to and between the bracket 148 of left side connector beam 54 of the left outrigger 12 and the other, centrally located outrigger hole 135 of control plate 120.

Figure 5:
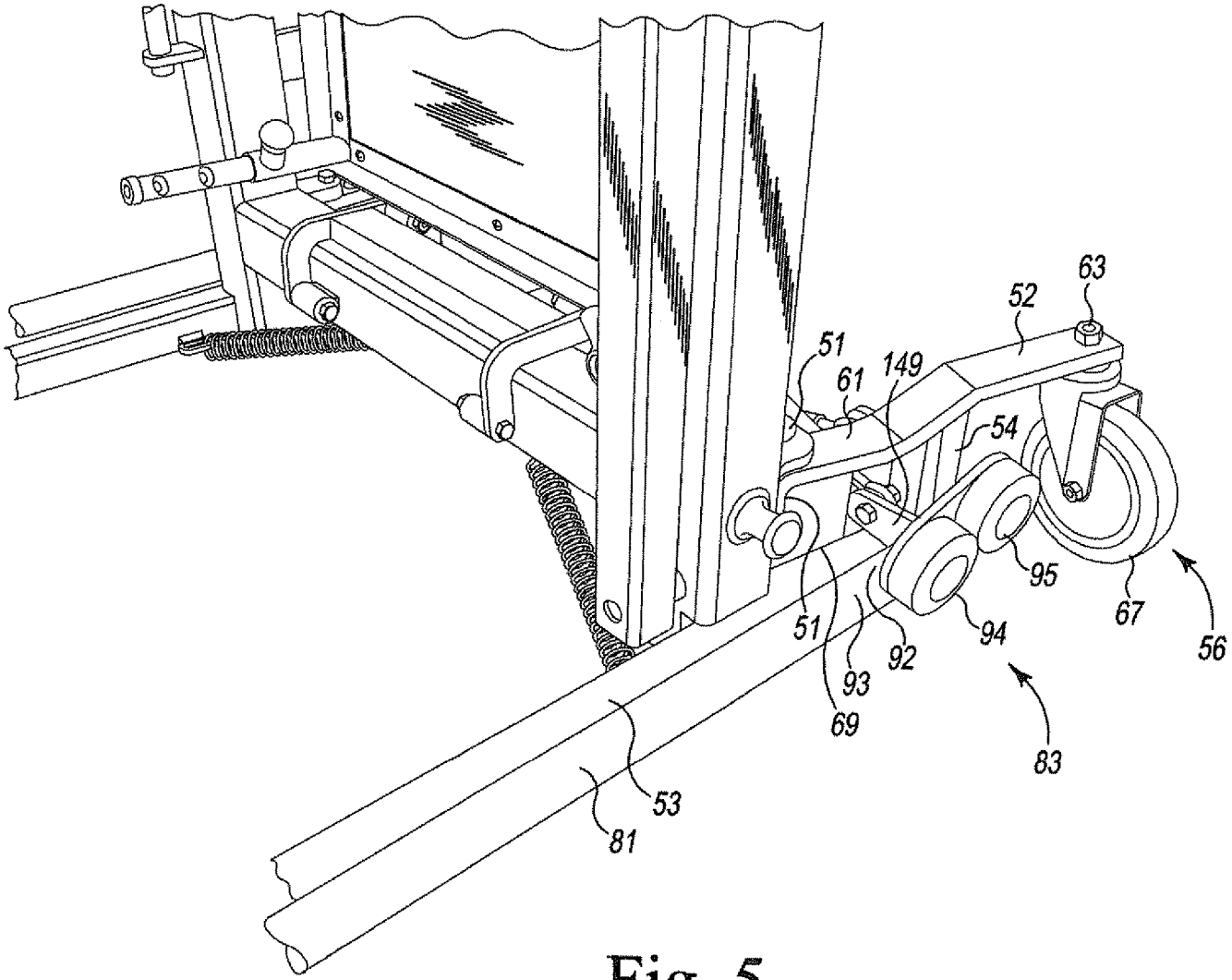
FIG. 5 is a left side, perspective view of the rear of the portable rehab station 10 of FIG. 4 and shown with the actuator mechanism 20 in the in the up, unlocked position 21.

The right stabilizer link 144 is pivotally connected at one end to control plate 120 at the nearest stabilizer hole 138. From there, stabilizer link 144 extends through the opening defined by (the right side) pivot sleeve 51, rear caster arm 52, connector beam 54 and long arm 53 and pivotally connects with the link bracket 96 of right stabilizer 15. The left stabilizer link 143 is similarly connected between control plate 120 at its other stabilizer hole 137 and the link bracket 149 of right stabilizer 14 (FIG. 5).

Actuator input assembly 112 includes any suitable device connected to the rearward end of control rod 117 to permit the user to rotate control rod 117 and move portable rehab station 10 between the up, unlocked position 21 and the down, locked position 24. In one embodiment, the actuator input assembly 112 includes a foot operated device where the user's foot pushes down on a lever (such as at 151 and 152 in FIG. 3) to rotate control rod 117. Alternative embodiments are contemplated wherein the actuator includes a hand operated device, such as a handle mechanically connected with and extending up from control rod 117, such as at 153. To maximize the advantage, such handle is contemplated to have a telescoping rod (154, FIG. 1) that can be pulled out and increase the radial arm from control rod 117.

Figure 11:
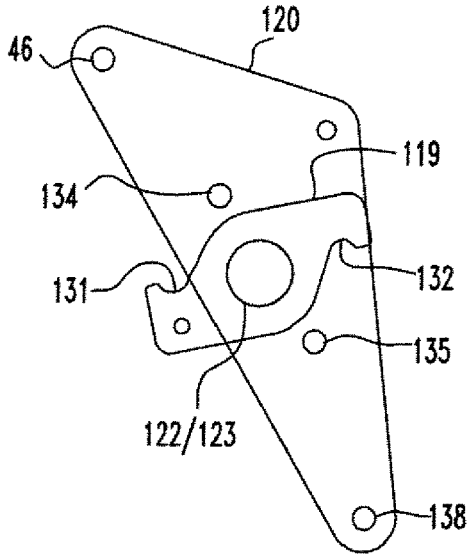
FIG. 11 rear, elevational view of the index plate 119 and control plate 120 of the center control assembly 110 of FIG. 10, with control plate 120 shown rotated to the position.
Figure 12:
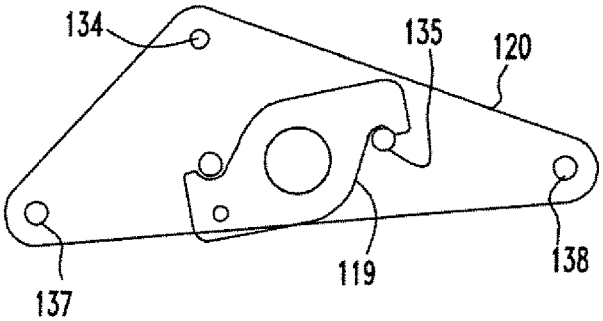
FIG. 12 rear, elevational view of the index plate 119 and control plate 120 of FIG. 11, with control plate 120 shown rotated to the position.
Figure 6:
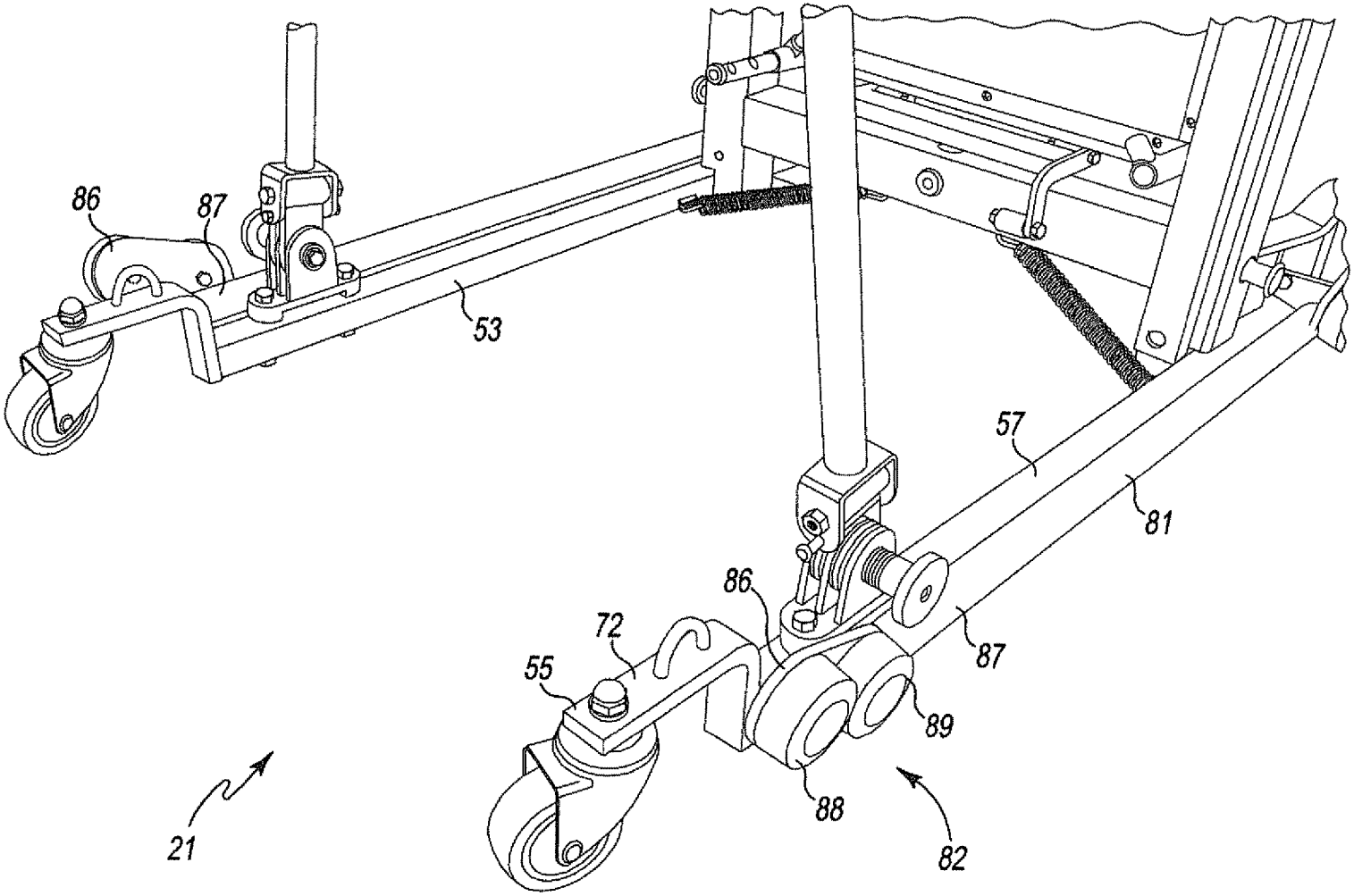
FIG. 6 is a left side, perspective view of the front of the portable rehab station 10 of FIG. 4 and shown with the actuator mechanism 20 in the in the up, unlocked position 21.
Figure 7:
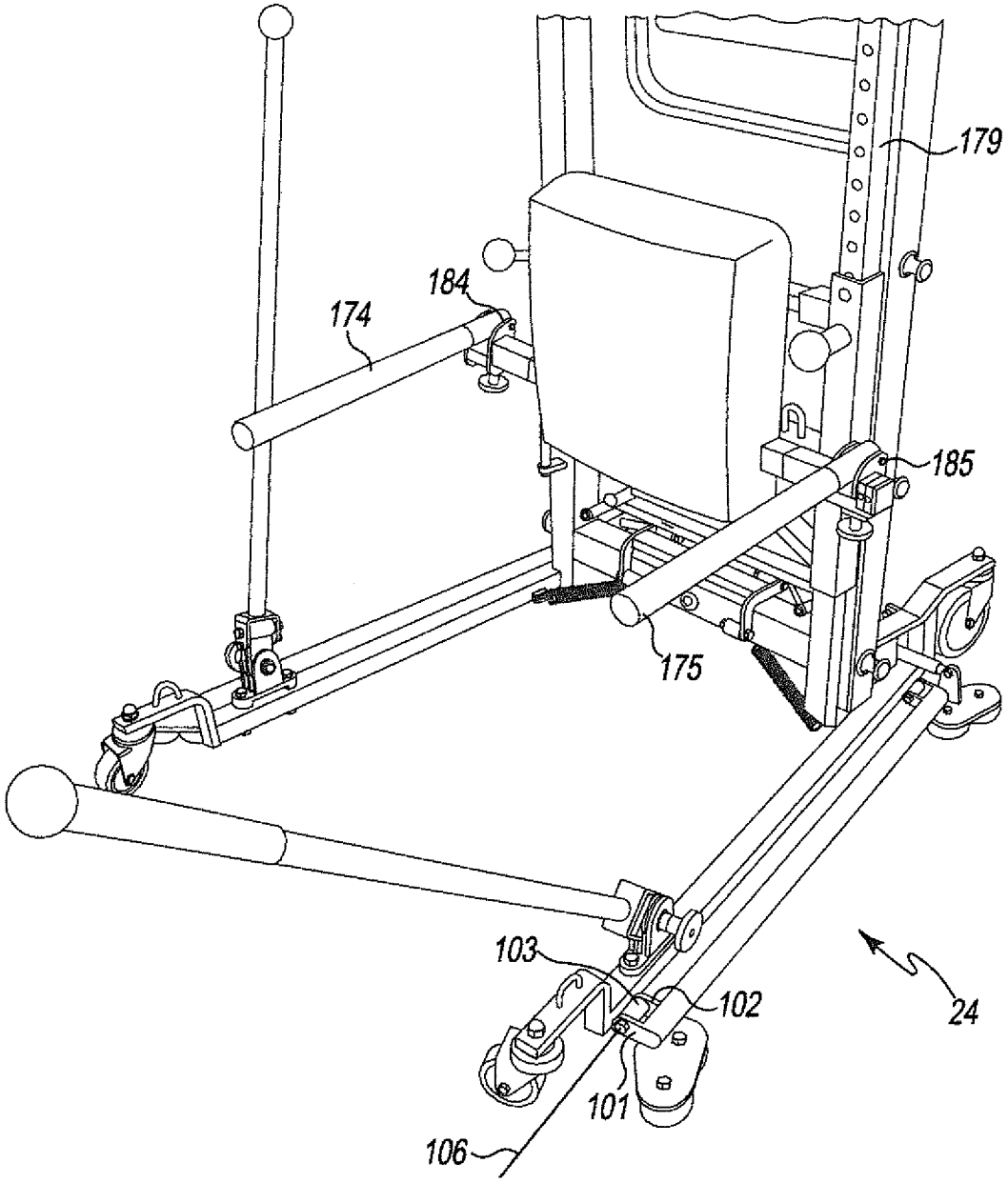
FIG. 7 is a left side, perspective view of the front of the portable rehab station 10 of FIG. 4 and shown with the actuator mechanism 20 in the down, unlocked position 24.

In the up, unlocked position 21 (FIG. 3), portable rehab station 10 is supported on its casters and can roll freely; control plate 120 is in the position shown in FIG. 11 relative to index plate 119; and outriggers 12 and 13 are mutually parallel (a retracted position), having a width suitable to pass through standard doorways (a retracted position, as shown in FIG. 6, for example). When foot lever 151 is pushed down or handle 153 (or similar device) is pivoted counterclockwise (as viewed in FIG. 3), control rod 117 and control plate 120 connected therewith rotate as a unit about central support rod 118. Consequently, outrigger links 141 and 142 are drawn inwardly, which pulls the rear ends of outriggers 12 and 13 inwardly, which pivots them about their pivotal mountings at the bottom of vertical beams 36 and 37 and outriggers 12 and 13 open up. That is, outriggers 12 and 13 spread out to an expanded position between about six and 10 degrees, with 10 degrees being preferable (as shown in FIG. 7, for example). In this position, portable rehab station 10 is more stable as a person goes through any of the many different therapy regimes, including resistance/strength training; balance and agility training; functional training; endurance/aerobic training; and flexibility training. Such regimes will typically include the use of several different pieces of equipment, any of which, as well is those not yet known, but now more easily instituted, can be performed and are contemplated to be performed at the portable rehab station 10. Examples of such routines contemplated to made available at the portable rehab station 10 include resistance/strength training incorporating application of resistance in opposition to the force of muscular contraction, the resistance being provided by tension via elastic, hydraulic or suspended mass (weights) components, which items can easily be carried in the drawer 161 located below the workout and utility table 162 mounted to the frame 11. Also included are endurance/aerobic training including light-to-moderate exercising for extended periods of time, such as rowing, walking or jogging which can be performed on equipment attached to the portable rehab station 10 (such as a rowing machine, treadmill or the like). For example, portable rehab station 10 includes light duty, adjustable resistance walking sticks 163 (the stick mounted to right outrigger 13 being removed from FIG. 1 to enable the other components to be seen).

In the expanded position where outriggers 12 and 13 are spread out by as much as 10 degrees (and more, in other contemplated embodiments), a wheelchair can be wheeled between the outriggers to enable the occupant to perform the exercises. Wheelchair seats and frames are typically about 20 inches width, plus another three to five inches for the wheels. In the up, unlocked position 21, the outrigger 12 and 13 are about 20 inches apart on the inside so that the overall wide enables portable rehab station 10 to be wheeled through doorways and down hallways. In the down, locked position 24, however, outrigger 12 and 13 spread out, at their forward ends to about 28 inches, which allows most wheelchairs to easily maneuver therebetween.

The second and equally important consequence of control rod 117 and control plate 120 rotating as a unit about central support rod 118 is that the stabilizer links 143 and 144 are pushed outwardly, which, by their pivotal connection to link brackets 96 and 149, rotates stabilizers 14 and 15 about their pivotal connections to outriggers 12 and 13, which forces the front and rear feet 82 and 83 and their grip pads to 88, 89, 94 and 95 of the stabilizers to engage the floor and lift portable rehab station 10 up off its casters. Portable rehab station 10 is now substantially immovable given its weight and the high frictional coefficient between the grip pads and most floors.

Figure 8:
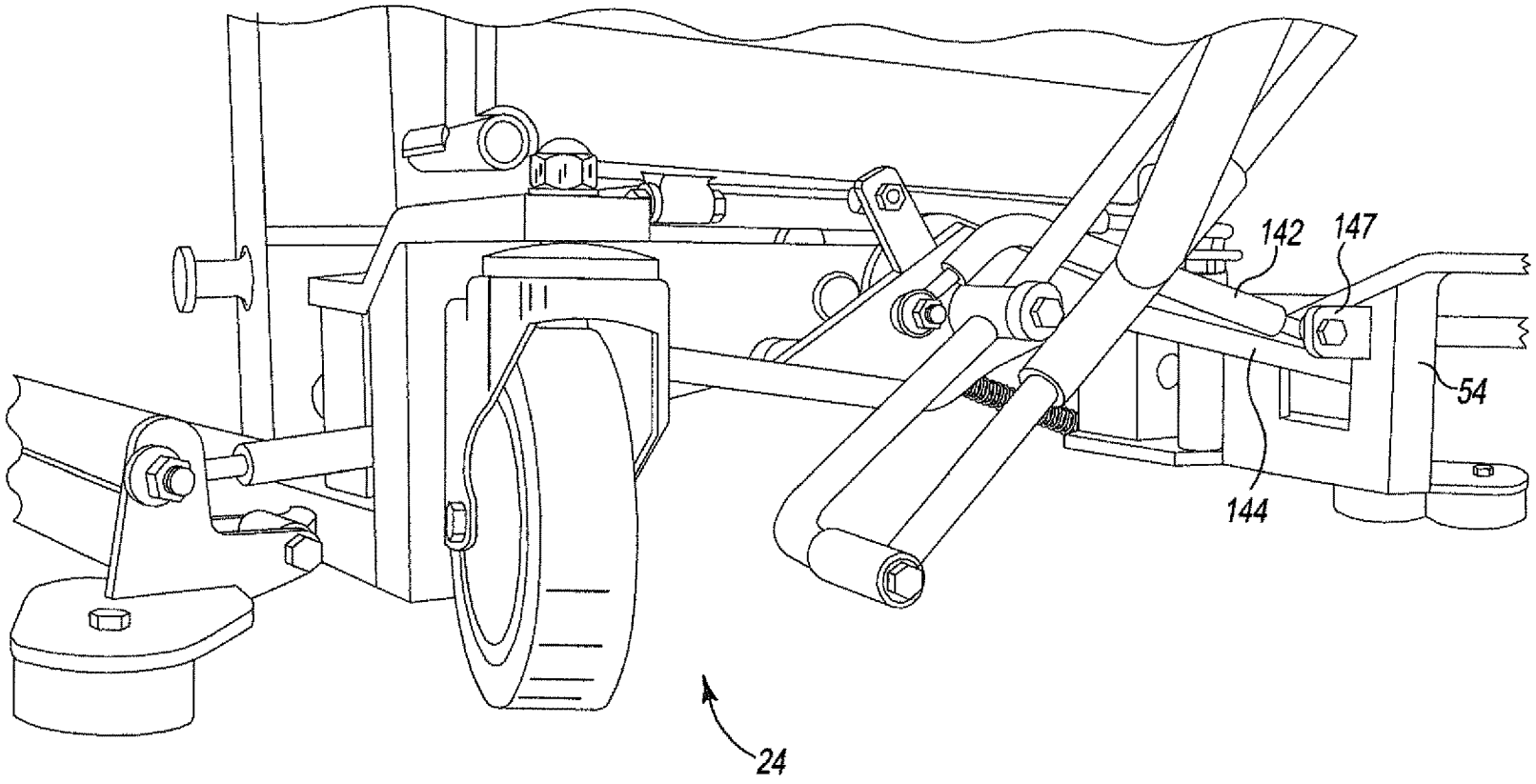
FIG. 8 is a rear, lower perspective view of the portable rehab station 10 of FIG. 4.

Also of considerable importance are the locations of the outrigger holes 134 and 135 relative to the central support rod 118 and the outer connections of outrigger links 141 and 142. As seen in FIGS. 8 and 9, when portable rehab station 10 is the down, locked position 24, the connections of outrigger links 141 and 142 at the outrigger holes 134 and 135 have passed over center, that is past the axis of central support rod 118. Thus the weight of portable rehab station 10 upon stabilizers 14, which is transmitted through the all linkages, acts to urge control plate 120 to rotate further counterclockwise and thus stay in the down, locked position 24. The over center forces created by the present invention are not so great, however, that one cannot easily unlock the mechanism by manually (or with the feet, depending on the configuration) rotating the control rod 117 clockwise with the actuator input assembly 112.

The connections of outrigger links 141 and 142 at holes 134 and 135 include bolts or some appropriate fastener that extends out forwardly of control plate 120. These bolts engage with notches 131 and 132 and define the limit of counterclockwise rotation of control plate 120, which thus prevents damage from the outrigger links 141 and 142 hitting the control rod 117.

Portable rehab station 10 contains other features readily shown in the figures. For example, portable rehab station 10 includes a combination table top 171, seat 172 and cushion 173 for use in the various rehab exercises. Arms 174 and 175 are pivotally mounted to a carriage 176 that rides up and down a track 179 and 180. The vertical position can be set by a pin and hole arrangement (at 181/182). The arms 174 and 175 can support table top 171, and when arms 174 and 175 and their carriage are moved to a lower position, the table top 171 becomes a seat for a rehab patient not seated in a wheelchair. The width of the arms 174 and 175 are adjustable along the horizontal support bar 183 via adjustment mechanisms 184 and 185. The arms are pivotally mounted at the adjustment mechanisms to they can be pivoted up and out of the way for certain exercises such as walking on a treadmill (not shown) that would be provided with portable rehab station 10. The cushion is useful in the down position for bracing one's knees thereagainst, and for other exercises at other heights.

In the embodiment of FIG. 1, the vertical beams 36 and 37 are split, the upper portions being telescopically received in the lower portions and a lift mechanism is provided to move the upper portion between the up and down positions. Such mechanism includes a lever 190 connected to a rotating bar 191 that is pivotally connected to a pair of rods 193 and 194 that are connected at their upper ends (at 195 and 196) to the upper beams 201 and 202. Rotating bar 191 raises the upper beams 201 and 202 to give another four to eight inches of height. Thus, the various hooks 204 along the upper equipment support arms can services taller peoples and can accommodate other exercise equipment and routines that might not otherwise be available. The ability to then lower the upper frame portion is important to enable portable rehab station 10 to be able to pass through standard doorways.

Alternate configurations are contemplated for the configuration of stabilizers 14 and 15 so long as it is pivotally mounted to outriggers 12 and 13 to pivot between the up and the down positions where ground engaging pads such as pads 88, 89, 94 and 95 engage the ground and the rest of the portable rehab station connected to stabilizers 14 and 15, and particularly the casters 22, is lifted off the ground so that portable rehab station 10 rests solely upon the pads.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A portable rehab station configured for rehabilitation exercises by a user, comprising:

a frame having left and right frame members that have bottom ends;

left and right outriggers pivotally connected to said frame to pivot between retracted and expanded positions;

ground-engageable casters connected to said left and right outriggers;

left and right stabilizers pivotably connected to respective left and right outriggers to pivot between an up, unlocked position and a down, locked position, the down, locked position including the stabilizers being in engagement with a ground to resist free rolling movement of the portable rehab station along the ground; and an actuator assembly having a control plate journaled to said frame for rotation about an axis and left and right outrigger links connected between the control plate and said left and right outriggers, and wherein rotation of the control plate moves said left and right outriggers between the retracted and expanded positions and wherein said actuator assembly further includes left and right stabilizer links connected between the control plate and said left and right stabilizers, and wherein rotation of the control plate moves said left and right stabilizers, via the left and right stabilizer links, between the up, unlocked position and the down, locked position.

2. The portable rehab station of claim 1 wherein each stabilizer includes a bar pivotally connected to its corresponding outrigger and front and rear feet connected to opposing ends of each bar.

3. The portable rehab station of claim 2 wherein each of the front and rear feet includes ground-engaging grip pads.

4. A method for moving and securing a portable rehab station configured for rehabilitation exercises by a user comprising the steps of:

providing a portable rehab station configured for rehabilitation exercises by a user, the portable rehab station including a frame having left and right frame members; left and right outriggers pivotally connected to the frame to pivot between retracted and expanded positions; ground-engageable casters connected to the left and right outriggers; left and right stabilizers pivotably connected to respective left and right outriggers to pivot between an up, unlocked position and a down, locked position in engagement with a ground; and an actuator assembly having a control plate journaled to the frame for rotation about an axis, left and right outrigger links connected between the control plate and the left and right outriggers, and left and right stabilizer links connected between the control plate and the left and right stabilizers;

exerting a lateral force against the portable rehab station to move the station along a ground, to a desired location, via its casters while the casters are engaged with the ground;

stabilizing the portable rehab station by rotating the control plate to pivot the outriggers, via the left and right outrigger links, from their retracted to their expanded positions.

5. The method for moving and securing a portable rehab station configured for rehabilitation exercises by a user of claim 4 wherein said stabilizing step includes rotating the control plate to simultaneously pivot the outriggers, via the left and right outrigger links, from their retracted to their expanded positions and pivot the stabilizers, via the left and right stabilizer links from their up, unlocked position to their down, locked position in engagement with a ground.

6. The method for moving and securing a portable rehab station configured for rehabilitation exercises by a user of claim 5 wherein said stabilizing step includes the down, locked position including the portable rehab station being raised, support on the left and right stabilizers, and the casters not being engaged with the ground.

* * * * *